US009167344B2

(12) United States Patent
Choueiri

(10) Patent No.: US 9,167,344 B2
(45) Date of Patent: Oct. 20, 2015

(54) SPECTRALLY UNCOLORED OPTIMAL CROSSTALK CANCELLATION FOR AUDIO THROUGH LOUDSPEAKERS

(75) Inventor: Edgar Y. Choueiri, Princeton, NJ (US)

(73) Assignee: Trustees of Princeton University, Princeton, NJ (US)

( * ) Notice: Subject to any disclaimer, the term of this patent is extended or adjusted under 35 U.S.C. 154(b) by 230 days.

(21) Appl. No.: 13/820,230

(22) PCT Filed: Sep. 1, 2011

(86) PCT No.: PCT/US2011/050181

§ 371 (c)(1),
(2), (4) Date: Mar. 1, 2013

(87) PCT Pub. No.: WO2012/036912

PCT Pub. Date: Mar. 22, 2012

(65) Prior Publication Data

US 2013/0163766 A1 Jun. 27, 2013

Related U.S. Application Data

(60) Provisional application No. 61/379,831, filed on Sep. 3, 2010.

(51) Int. Cl.
*H04R 5/04* (2006.01)
*H04R 3/04* (2006.01)
(Continued)

(52) U.S. Cl.
CPC *H04R 3/04* (2013.01); *H04S 1/002* (2013.01); *H04R 3/12* (2013.01); *H04R 5/04* (2013.01); *H04R 2430/03* (2013.01); *H04S 2420/01* (2013.01)

(58) Field of Classification Search
CPC ... G10L 19/008; G10L 19/00; G10L 21/0208; H04R 3/005; H04R 3/00; H04R 3/02; H04S 5/00; H04M 9/082
USPC ..... 381/309–310, 314, 316, 1, 17–20, 66, 381/94.1–94.3
See application file for complete search history.

(56) References Cited

U.S. PATENT DOCUMENTS 6,668,061 B1 12/2003 Abel
6,950,524 B2 9/2005 Nelson et al.
(Continued)

FOREIGN PATENT DOCUMENTS

JP 2004-511118 A 4/2004

OTHER PUBLICATIONS

Bai, et al., "Optimal Design of Loudspeaker Arrays for Robust Cross-Talk Cancellation Using the Taguchi Method and the Genetic Algorithm," The Journal of the Acoustical Society of America, vol. 117, No. 5, pp. 2802-2813 (May 1, 2005).
Choueiri, Edgar Y., "Optimal Crosstalk Cancellation for Binaural Audio with Two Loudspeakers," Princeton University, pp. 1-24 Retrieved from the Internet: [URL:http://www.princeton.edu/3D3A/Publications/BACCHPaperV4d.pdf] (Nov. 13, 2010).
(Continued)

*Primary Examiner* — Rasha Al Aubaidi
(74) *Attorney, Agent, or Firm* — Wilmer Cutler Pickering Hale and Dorr LLP

(57) ABSTRACT

A method and system for calculating the frequency-dependent regularization parameter (FDRP) used in inverting the analytically derived or experimentally measured system transfer matrix for designing and/or producing crosstalk cancellation (XTC) filters relies on calculating the FDRP that results in a flat amplitude vs frequency response at the loudspeakers, thus forcing XTC to be effected into the phase domain only and relieving the XTC filter from the drawbacks of audible spectral coloration and dynamic range loss. When the method and system are used with any effective optimization technique, it results in XTC filters that yield optimal XTC levels over any desired portion of the audio band, impose no spectral coloration on the processed sound beyond the spectral coloration inherent in the playback hardware and/or loudspeakers, and cause no (or arbitrarily low) dynamic range loss.

18 Claims, 9 Drawing Sheets

(51) Int. Cl.
*H04S 1/00* (2006.01)
*H04R 3/12* (2006.01)

(56) References Cited

U.S. PATENT DOCUMENTS

| | | | |
|---|---|---|---|
| 2004/0170281 | A1 | 9/2004 | Nelson et al. |
| 2005/0135643 | A1 | 6/2005 | Lee et al. |
| 2005/0254660 | A1 | 11/2005 | Sakurai et al. |
| 2009/0086982 | A1 | 4/2009 | Kulkarni et al. |
| 2010/0202629 | A1 | 8/2010 | Takeuchi et al. |

OTHER PUBLICATIONS

Supplementary European Search Report Issued by the European Patent Office for European Application No. EP 11 82 5672 mailed Mar. 10, 2014 (6 pgs.).

International Search Report and Written Opinion Issued by the U.S. Patent and Trademark Office as International Searching Authority for International Application No. PCT/US2011/050181 mailed Dec. 23, 2011 (8 pgs.).

Office Action issued by the Japan Patent Office for Japanese Patent Application No. 2013-527311 dated Apr. 27, 2015 (3 pgs.).

SPECTRALLY UNCOLORED OPTIMAL CROSSTALK CANCELLATION FOR AUDIO THROUGH LOUDSPEAKERS

CROSS REFERENCE TO RELATED APPLICATIONS

This application claims the benefit of U.S. provisional application No. 61/379,831 entitled "OPTIMAL CROSSTALK CANCELLATION FOR BINAURAL AUDIO WITH TWO LOUDSPEAKERS" filed on Sep. 3, 2010, the contents of which are hereby incorporated by reference herein.

BACKGROUND

Binaural audio with loudspeakers (BAL), also known as transauralization, aims to reproduce, at the entrance of each of the listener's ear canals, the sound pressure signals recorded on only the ipsilateral channel of a stereo signal. That is, only the sound signal of the left stereo channel is reproduced at the left ear and only the sound signal of the right stereo channel is reproduced at the right ear. For example, if the source signal was encoded with a head-related transfer function (HRTF) of the listener, or includes the proper interaural time difference (ITD) and interaural level difference (ILD) cues, then delivering the signal on each of the channels of the stereo signal to the ipsilateral ear, and only to that ear, would ideally guarantee that the car-brain system receives the cues it needs to hear an accurate 3-dimensional (3-D) reproduction of a recorded soundfield.

However, an unintended consequence of binaural audio playback through loudspeakers is crosstalk. Crosstalk occurs when the left ear (right ear) hears sounds from the right (left) audio channel, originating from the right speaker (left speaker). In other words, crosstalk occurs when the sound on one of the stereo channels is heard by the contralateral ear of the listener.

Crosstalk corrupts HRTF information and ITD or ILD cues so that a listener may not properly or completely comprehend the soundfield's binaural cues that are embedded in the recording. Therefore, approaching the goal of BAL requires an effective cancellation of this unintended crosstalk, i.e. crosstalk cancellation or XTC for short.

While there are various techniques for effecting some level of crosstalk cancellation (XTC) for a two loudspeaker system, they all have one or more of the following drawbacks:

D1: Severe spectral coloration to the sound heard by the listener, even if that listener is sitting in the intended sweet spot.

D2: Useful XTC levels are reached only at limited frequency ranges of the audio band.

D3: Severe dynamic range loss when the sound is processed through the XTC filter or processor (while avoiding distortion and/or clipping).

The above drawbacks can be seen by analyzing XTC using the most fundamental formulation of the XTC problem—that is by looking at the inverse of the system transfer matrix (as will be shown and discussed below) that describes sound propagation from the loudspeakers to the ears of the listener.

While the technique of constant parameter (non-frequency dependent) regularization, commonly used in XTC filter design to make the inversion of the system transfer matrix better behaved, may alleviate some of Drawback D3, it inherently introduces spectral artifice of its own (specifically, at the expense of reducing the amplitude of the spectral peaks in the inverted transfer matrix, constant-parameter regularization results in undesirable narrow-band artifacts at higher frequencies and a rolloff at lower frequencies at the loudspeakers) and does little to alleviate the other two drawbacks (D1 and D2).

Prior art frequency-dependent regularization, even when coupled with an effective optimization scheme, is not enough to deal away with Drawbacks D1, D2 and D3.

Previous XTC filter design methods based on system transfer matrix inversion (with or without regularization) strive to maintain a flat amplitude vs. frequency response at the ears of the listener by imposing a non-flat amplitude vs frequency response at the loudspeakers (as explained below), which causes a loss in the dynamic range of the processed sound, and, for reasons that will be explained below, leads to a spectral coloration of the sound as heard by the listener, even if the listener is sitting in the intended sweet spot.

Therefore, while previous methods are useful for designing XTC filters that can inherently correct for non-idealities in the amplitude vs frequency response of the playback hardware and loudspeakers, they do not address all of Drawbacks D1, D2 and D3.

SUMMARY

A method and system for calculating the frequency-dependent regularization parameter (FDRP) used in inverting the analytically derived or experimentally measured system transfer matrix for crosstalk cancellation (XTC) filter design is described. The method relies on calculating the FDRP that results in a flat amplitude vs frequency response at the loudspeakers (as opposed to a flat amplitude vs frequency response at the ears of the listener, as inherently done in prior art methods) thus forcing XTC to be effected into the phase domain only and relieving the XTC filter from the drawbacks of audible spectral coloration and dynamic range loss. When the method is used with any effective optimization scheme it results in XTC filters that yield optimal XTC levels over any desired portion of the audio band, impose no spectral coloration on the processed sound beyond the spectral coloration inherent in the playback hardware and/or loudspeakers, and cause no dynamic range loss. XTC filters designed with this method and used in the system are not only optimal but, due to their being free from Drawbacks D1, D2 and D3, allow for a most natural and spectrally transparent 3D audio reproduction of binaural or stereo audio through loudspeakers. The method and system do not attempt to correct the spectral characteristics of the playback hardware, and therefore are best suited for use with audio playback hardware and loudspeakers that are designed to meet a desired spectral fidelity level without the help of additional signal processing for spectral correction.

DESCRIPTION OF THE DRAWINGS

A more detailed understanding of the present invention may be had from the following detailed description which should read in light of the accompanying drawings wherein.

DETAILED DESCRIPTION

In order to explain the advantages of the method and system of the present invention an analytical formulation of the fundamental XTC problem in an idealized situation will be described and the "perfect XTC filter" will be defined, which will serve as a benchmark illustrating the severe problem of audible spectral coloration inherent to all XTC filters.

In the following description, for the sake of clarity and to allow analytical insight, an idealized situation will be used consisting of two point sources (idealized loudspeakers) 12, 14 in free space (no sound reflections) and two listening points 16, 18 corresponding to the location of the ears of an idealized listener 20 (no HRTF). However, in the example given following the description of the invention, actual data corresponding to the impulse responses of real loudspeakers in a real room measured at the ear canal entrances of a dummy head will be used.

Formulation of the Fundamental XTC Problem

Figure 1:
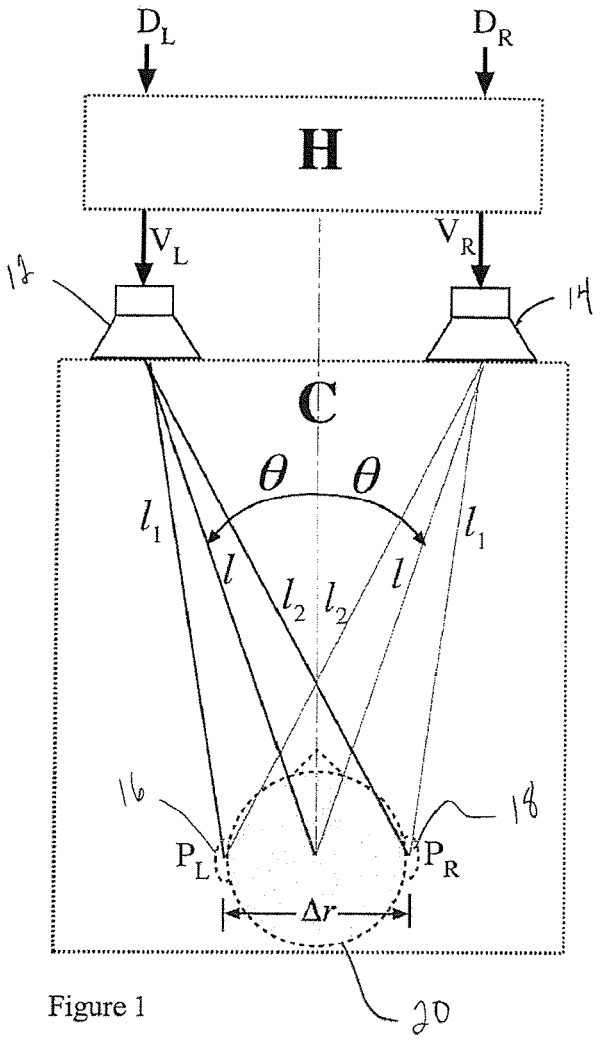
FIG. 1 is a diagram of a listener and a two-source model.

In the frequency domain, the air pressure at a free-field point located a distance r from a point source (monopole) radiating a sound wave of frequency ω, under the idealizing assumptions that sound propagation occurs in a free field (with no diffraction or reflection from the head and pinnae of the listener or any other physical objects), and that the loudspeakers radiate like point sources, is given by:

$$P(r, i\omega) = \frac{i\omega\rho_o q}{4\pi}\frac{e^{-ikr}}{r},$$

where $\rho_o$ is the air density, $k2\pi/\lambda=\omega/c_s$ is the wavenumber, λ is the wavelength, $c_s$ is the speed of sound (340.3 m/s), and q is the source strength (in units of volume per unit time). Defining the mass flow rate of air from the center of the source, V, as:

$$V = \frac{i\omega\rho_o q}{4\pi},$$

which is the time derivative of $$\frac{\rho_o q}{4\pi},$$

in the symmetric two-source geometry shown in FIG. 1 the air pressure due to the two sources 12, 14, under the above stated assumptions, add up as $$P_L(i\omega) = \frac{e^{-ikl_1}}{l_1}V_L(i\omega) + \frac{e^{-ikl_2}}{l_2}V_R(i\omega). \tag{1}$$

Similarly, at the right ear 18 of the listener 20 the following is the sensed pressure:

$$P_R(i\omega) = \frac{e^{-ikl_2}}{l_2}V_L(i\omega) + \frac{e^{-ikl_1}}{l_1}V_R(i\omega). \tag{2}$$

Here, $l_1$ and $l_2$ are the path lengths between any of the two sources 12, 14 and the ipsilateral and contralateral ear, respectively, as shown in FIG. 1.

Throughout this specification, uppercase letters represent frequency variables, lowercase represent time-domain variables, uppercase bold letters represent matrices, and lowercase bold letters represent vectors, and define $$\Delta l \equiv l_2 - l_1 \text{ and } g \equiv l_1/l_2 \tag{3}$$

as the path length difference and path length ratio, respectively.

Because the contralateral distance in the geometry of FIG. 1 is greater than the ipsilateral distance, then $0<g<1$. Further, from the geometry in FIG. 1, the two distances may be expressed as:

$$l_1 = \sqrt{l^2 + \left(\frac{\Delta r}{2}\right)^2 - \Delta r l \sin(\theta)}, \tag{4}$$

$$l_2 = \sqrt{l^2 + \left(\frac{\Delta r}{2}\right)^2 + \Delta r l \sin(\theta)}, \tag{5}$$

where Δr is the effective distance between the entrances of the ear canals, and l is the distance between either source and the interaural mid-point of the listener. As defined in FIG. 1, $\Theta=2\theta$ is the loudspeaker span. Note that for $l \gg \Delta r \sin(\theta)$, as in many loudspeaker-based listening set-ups, which leads to $g \approx 1$. Another important parameter is the time delay, $$\tau_c = \frac{\Delta l}{c_s} \tag{6}$$

defined as the time it takes a sound wave to traverse the path length difference Δl.

Using equations (1) and (2), the received signal at the listener's left ear 16 and the received signal at the listener's right ear 18 may be written in vector form as:

$$\begin{bmatrix} P_L(i\omega) \\ P_R(i\omega) \end{bmatrix} = \alpha \begin{bmatrix} 1 & g e^{-i\omega\tau_c} \\ g e^{-i\omega\tau_c} & 1 \end{bmatrix} \begin{bmatrix} V_L(i\omega) \\ V_R(i\omega) \end{bmatrix} \tag{7}$$

$$p = \alpha C v$$

where $$\alpha = \frac{e^{-i\omega l_1/c_s}}{l_1} \tag{8}$$

which, in the time domain, is a transmission delay (divided by the constant $l_1$) that does not affect the shape of the received signal. The source vector at the loudspeaker comprising a left channel, $V_L$, and a right channel, $V_R$, is written in vector form as $v=[V_L(i\omega),V_R(i\omega)]^T$. v may be obtained from the two channels of "recorded" signals, denoted $d=[D_L(i\omega),D_R(i\omega)]^T$, using the transformation $$v = Hd \tag{9}$$

where $$H = \begin{bmatrix} H_{LL}(i\omega) & H_{LR}(i\omega) \\ H_{RL}(i\omega) & H_{RR}(i\omega) \end{bmatrix} \tag{10}$$

is the sought 2×2 filter or transformation matrix for XTC. Therefore, from Eq. (7), the following result may be obtained $$p = \alpha CHd \tag{11}$$

where $p=[P_L(i\omega),P_R(i\omega)]^T$ is the vector of pressures at the ears, and C is the system's transfer matrix $$C \equiv \begin{bmatrix} 1 & ge^{-i\omega\tau_c} \\ ge^{-i\omega\tau_c} & 1 \end{bmatrix} \tag{12}$$

which is symmetric due to the symmetry of the geometry shown in FIG. 1.

In summary, the transformation from the signal d, through the filter H, to the source variables v, then through wave propagation from the loudspeaker sources to pressure, p, at the ears of the listener, can be written as $$p = \alpha \underbrace{CHd}_{R} \tag{13}$$

$$p = \alpha Rd$$

where the performance matrix, R, is defined as $$R = \begin{bmatrix} R_{LL}(i\omega) & R_{LR}(i\omega) \\ R_{RL}(i\omega) & R_{RR}(i\omega) \end{bmatrix} \equiv CH \tag{14}$$

The diagonal elements of R (i.e., $R_{LL}(i\omega)$ and $R_{RR}(i\omega)$) represent the ipsilateral transmission of the recorded sound signal to the ears, and the off-diagonal elements (i.e., $R_{RL}(i\omega)$ and $R_{LR}(i\omega)$) represent the undesired contralateral transmission, i.e., the crosstalk.

Performance Metrics

A set of metrics by which to judge the spectral coloration and performance of XTC filters will now be described. The amplitude spectrum (to a factor α) of a signal fed to only one (either left or right) of the two inputs of the system, as heard at the ipsilateral ear is $$E_{si||}(\omega)) \equiv |R_{LL}(i\omega)| = |R_{RR}(i\omega)|$$

where the subscripts "si" and || stand for "side image" and "ipsilateral ear (with respect to the input signal)", respectively, since $E_{si||}$, as defined, is the frequency response (at the ipsilateral ear) for the side image that would result from the input being panned to one side. Similarly, at the contralateral ear to the input signal (subscript X), the following is the side-image frequency response:

$$E_{si_x}(\omega) \equiv |R_{LR}(i\omega)| = |R_{LR}(i\omega)|$$

The system's frequency response at either ear when the same signal is split equally between left and right inputs is another spectral coloration metric:

$$E_{ci}(\omega) \equiv \left|\frac{R_{LL}(i\omega) + R_{LR}(i\omega)}{2}\right| = \left|\frac{R_{RL}(i\omega) + R_{RR}(i\omega)}{2}\right|,$$

Here the subscript "ci" stands for "center image" since $E_{ci}$, as defined, is the frequency response (at either ear) for the center image that would result from the input being panned to the center.

Also of importance are the frequency responses that would be measured at the sources (i.e., the loudspeakers), which are denoted by S and may be obtained from the elements of the filter matrix H:

$$S_{si||}(\omega) \equiv |H_{LL}(i\omega)| = |H_{RR}(i\omega)|$$

$$S_{si_X}(\omega) \equiv |H_{LR}(i\omega)| = |H_{RL}(i\omega)|$$

$$S_{ci}(\omega) \equiv \left|\frac{H_{LL}(i\omega) + H_{LR}(i\omega)}{2}\right| = \left|\frac{H_{RL}(i\omega) + H_{RR}(i\omega)}{2}\right|$$

They are given using the same subscript convention used with the amplitude spectrum above (with "||" and "X" referring to the loudspeakers that are ipsilateral and contralateral to the input signal, respectively). An intuitive interpretation of the significance of the above metrics is that a signal panned from a single input to both inputs to the system will result in frequency responses going from $E_{si}$ to $E_{ci}$ at the ears, and $S_{si}$ to $S_{ci}$ at the loudspeakers.

Two other spectral coloration metrics are the frequency responses of the system to in-phase and out-of-phase inputs to the system. These two responses are given by:

$$S_i(\omega) \equiv |H_{LL}(i\omega)+H_{LR}(i\omega)| = |H_{RL}(i\omega)+H_{RR}(i\omega)|$$

$$S_o(\omega) \equiv |H_{LL}(i\omega)-H_{LR}(i\omega)| = |H_{RL}(i\omega)-H_{RR}(i\omega)|$$

The subscripts i and o denote the in-phase and out-of-phase responses, respectively. Note that, as defined, $S_i$ is double (i.e., 6 dB above) $S_{ci}$, as the latter describes a signal of amplitude 1 panned to center (i.e., split equally between L and R inputs), while the former describes two signals of amplitude 1 fed in phase to the two inputs of the system.

Since a real signal can comprise various components having different phase relationships, it is useful to combine $S_i(\omega)$ and $S_o(\omega)$ into a single metric, $\hat{S}(\omega)$, which is the envelope spectrum that describes the maximum amplitude that could be expected at the loudspeakers, and is given by $$\hat{S}(\Omega) \equiv \max[S_i(\omega), S_o(\omega)].$$

It is relevant to note that $\hat{S}(\omega)$ is equivalent to the 2-norm of H, ||H||, and that $S_i$ and $S_o$ are the two singular values of H.

Finally, an important metric that will allow for the evaluation and comparison of the XTC performance of various filters is $\chi(\omega)$, the crosstalk cancellation spectrum:

$$\chi(\omega) \equiv \frac{|R_{LL}(i\omega)|}{|R_{RL}(i\omega)|} = \frac{|R_{RR}(i\omega)|}{|R_{LR}(i\omega)|} = \frac{|E_{si||}(\omega)|}{|E_{si_X}(\omega)|}.$$

It is the ratio of the amplitude spectrum at the ipsilateral ear to the amplitude spectrum at the contralateral ear and, therefore, the greater the value of the crosstalk cancellation spectrum, $\chi(\omega)$, the more effective is the crosstalk cancellation filter. The above definitions give a total of eight metrics, ($E_{si_u}$, $E_{si_x}$, $E_{ci}$, $S_{si_u}$, $S_{si_x}$, $S_{ci}$, $\hat{S}$, $\chi$), real functions of frequency, by which to evaluate and compare the spectral coloration and XTC performance of XTC filters.

Benchmark: Perfect Crosstalk Cancellation

A perfect crosstalk cancellation (P-XTC) filter may be defined as one that, theoretically, yields infinite crosstalk cancellation at the ears of the listener, for all frequencies. Crosstalk cancellation requires that the received signal at each of the two ears be that which would have resulted from the ipsilateral signal alone. Therefore, in order to achieve perfect cancellation of the crosstalk, Eq. (13) requires that R=CH=I, where I is the unity matrix (identity matrix), and thus, as per the definition of R in Eq. (14), the P-XTC filter is the inverse of the system transfer matrix expressed in Eq. (12), and may be expressed exactly:

$$H^{[P]} = C^{-1} = \frac{1}{1-g^2e^{-2i\omega\tau_c}}\begin{bmatrix} 1 & -ge^{-i\omega\tau_c} \\ -ge^{-i\omega\tau_c} & 1 \end{bmatrix} \tag{15}$$

where the superscript [P] denotes perfect XTC. For this filter, the eight metrics defined above become:

$$E_{si_{II}}^{[P]} = 1;\ E_{si_x}^{[P]} = 0;\ E_{ci}^{[P]} = \frac{1}{2}; \tag{16}$$

$$S_{si_{II}}^{[P]}(\omega) = \left|\frac{1}{1-g^2e^{-2i\omega\tau_c}}\right| = \frac{1}{\sqrt{g^4-2g^2\cos(2\omega\tau_c)+1}}$$

$$S_{si_\chi}^{[P]}(\omega) = \left|\frac{-ge^{-i\omega\tau_c}}{1-g^2e^{-2i\omega\tau_c}}\right| = \frac{g}{\sqrt{g^4-2g^2\cos(2\omega\tau_c)+1}}$$

$$S_{ci}^{[P]}(\omega) = \frac{1}{2}\left|1-\frac{g}{g+e^{i\omega\tau_c}}\right| = \frac{1}{2\sqrt{g^2-2g^2\cos(\omega\tau_c)+1}}$$

$$\hat{S}^{[P]}(\omega) = \max\left(\left|1-\frac{g}{g+e^{i\omega\tau_c}}\right|, \left|1+\frac{g}{e^{i\omega\tau_c}-g}\right|\right)$$

$$= \max\left(\frac{1}{\sqrt{g^2+2g\cos(\omega\tau_c)+1}}, \frac{1}{\sqrt{g^2-2g\cos(\omega\tau_c)+1}}\right)$$

$$\chi^{[P]}(\omega) = \infty \tag{17}$$

The perfect XTC filter ($\chi^{[P]}=\infty$) gives flat frequency responses at the ears (as evidenced by the constant $E_{si_u}^{[P]}$, $E_{si_x}^{[P]}$, and $E_{ci}^{[P]}$) and is effective at canceling crosstalk as evidenced by $E_{si_x}^{[P]}=0$, while preserving the ipsilateral signal as evidenced by an amplitude spectrum of 1, $E_{si_u}^{[P]}=1$. However, the spectra has a frequency varying behavior at the sources ($S_{si_u}^{[P]}(\omega)$, $S_{si_x}^{[P]}(\omega)$, $S_{ci}^{[P]}(\omega)$, and $\hat{S}^{[P]}(\omega)$) that constitute severe spectral coloration, which, as we shall see below, only in an ideal world (i.e. under the idealized assumptions of the model) is not heard at the ears.

Figure 2:
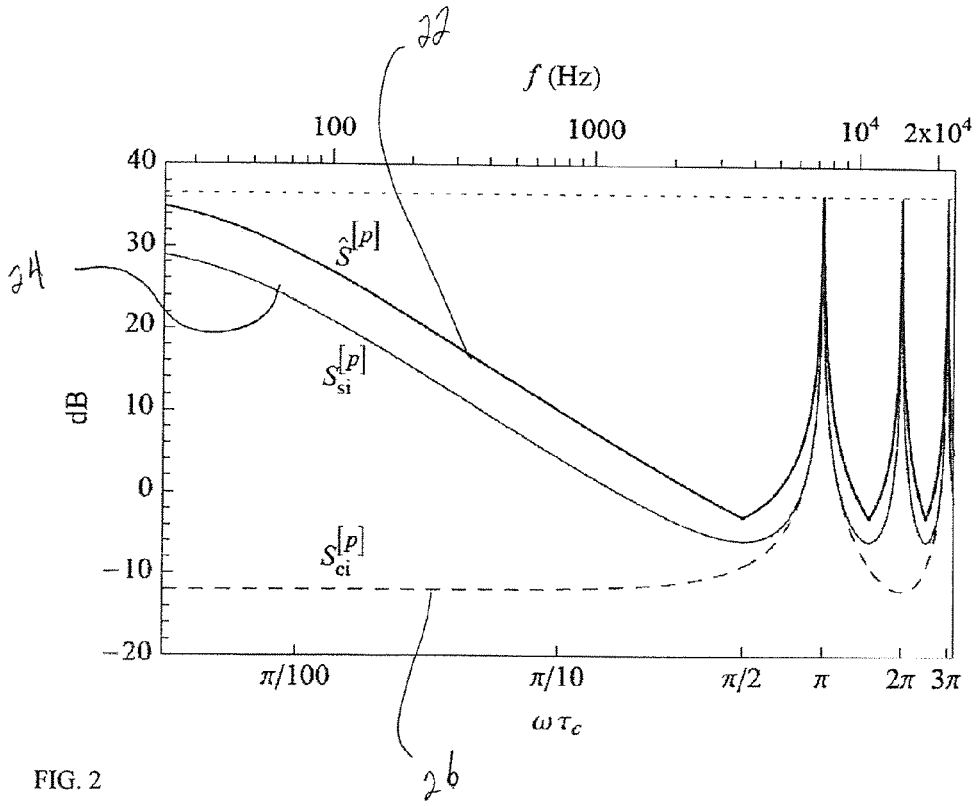
FIG. 2 is a plot of the frequency responses of the perfect XTC filter at the loudspeakers.

The extent of spectral coloration at the loudspeakers is plotted in FIG. 2 which shows the frequency responses of a Perfect XTC filter at the loudspeakers: amplitude envelope (curve 22), side image (curve 24), and central image (curve 26). The dotted horizontal line marks the envelope ceiling, which for this case (g=0.985) is 36.5 dB. The non-dimensional frequency $\omega/\tau_c$ is given on the bottom axis, and the corresponding frequency in Hz, shown on the top axis, is to illustrate a particular (typical) case of $\tau_c=3$ samples at the redbook CD sampling rate of 44.1 kHz. (which would be the case, for instance, of a set-up with $\Delta r=15$ cm, $l=1.6$ m, and $\Theta=10°$.)

The peaks in the $S_{si_u}^{[P]}(\omega)$, $S_{si_x}^{[P]}(\omega)$, $S_{ci}^{[P]}(\omega)$, and $\hat{S}^{[P]}(\omega)$ spectra occur shown in FIG. 2 at frequencies for which the amplitude of the signal at the loudspeakers must be boosted in order to effect XTC at the ears while compensating for the destructive interference at that location. Similarly, minima in the spectra occur when the amplitude must be attenuated due to constructive interference.

Using the first and second derivatives (with respect to $\omega\tau_c$) of the expressions for the various spectra, the amplitudes and frequencies for the associated peaks, denoted by the superscript ↑, and minima, denoted by the superscript ↓, are given by:

$$S_{si_{||}}^{[P]\uparrow} = \frac{1}{1-g^2} \text{ at } \omega\tau_c = n\pi, \text{ with } n = 0, 1, 2, 3, 4, \ldots \tag{18}$$

$$S_{si_{||}}^{[P]\downarrow} = \frac{1}{1+g^2} \text{ at } \omega\tau_c = n\frac{\pi}{2}, \text{ with } n = 1, 3, 5, 7, \ldots$$

$$S_{si_x}^{[P]\uparrow} = \frac{g}{1-g^2} \text{ at } \omega\tau_c = n\pi, \text{ with } n = 0, 1, 2, 3, 4, \ldots$$

$$S_{si_x}^{[P]\downarrow} = \frac{g}{1+g^2} \text{ at } \omega\tau_c = n\frac{\pi}{2}, \text{ with } n = 1, 3, 5, 7, \ldots$$

$$S_{ci}^{[P]\uparrow} = \frac{1}{2-2g} \text{ at } \omega\tau_c = n\pi, \text{ with } n = 1, 3, 5, 7, \ldots$$

$$S_{ci}^{[P]\downarrow} = \frac{1}{2+2g} \text{ at } \omega\tau_c = n\pi, \text{ with } n = 0, 2, 4, 6, \ldots$$

$$\hat{S}^{[P]\uparrow} = \frac{1}{1-g} \text{ at } \omega\tau_c = n\pi, \text{ with } n = 0, 1, 2, 3, 4, \ldots$$

$$\hat{S}^{[P]\downarrow} = \frac{1}{\sqrt{1+g^2}} \text{ at } \omega\tau_c = n\frac{\pi}{2}, \text{ with } n = 1, 3, 5, 7, \ldots \tag{19}$$

For a typical listening set-up, g≈1, say, a reference g=0.985 case shown in FIG. 2, the envelope peaks (i.e., $\hat{S}^{[P]\uparrow}$) correspond to a boost of $$20\log_{10}\left(\frac{1}{1-.985}\right) = 36.5 \text{ dB}$$

(and the peaks in the other spectra, $$S_{si_{||}}^{[P]\uparrow} \simeq S_{si_x}^{[P]\uparrow} \simeq S_{ci}^{[P]\uparrow},,$$

correspond to boosts of about 30.5 dB.) While these boosts have equal frequency widths across the spectrum, when the spectrum is plotted logarithmically (as is appropriate for human sound perception), the low-frequency boost is most prominent in its perceived frequency extent. This low frequency (i.e., bass boost) has been recognized as an intrinsic problem in XTC. While the high-frequency peaks could, in principle, he pushed out of the audio range by decreasing $\tau_c$ (which, as can be seen from Eqs. (4) to (6), is achieved by increasing l and/or decreasing the loudspeaker span, Θ, as is done in the so-called "Stereo Dipole" configuration, where Θ may be 10°), the "low frequency boost" of the P-XTC filter would remain problematic.

The severe spectral coloration associated with these high-amplitude peaks presents three practical problems: 1) it would be heard by a listener outside the sweet spot, 2) it would cause a relative increase (compared to unprocessed sound playback) in the physical strain on the playback transducers, and 3) it would correspond to a loss in the dynamic range.

These penalties might be a justifiable price if infinitely good XTC performance ($\chi=\infty$) and perfectly flat frequency response ($E^{[P]}(\omega)$=constant) that the perfect XTC filter promises were guaranteed at the ears of a listener in the sweet spot. However, in practice, these theoretically promised benefits are unachievable due to the solution's sensitivity to unavoidable errors. This problem can best be appreciated by evaluating the condition number of the transfer matrix C.

It is well known that in matrix inversion problems the sensitivity of the solution to errors in the system is given by the condition number of the matrix. The condition number $\kappa(C)$ of the matrix C is given by $$\kappa(C)=\|C\|\,\|C^{-1}\|=\|C\|\,\|H^{[P]}\|.$$

(It is also, equivalently, the ratio of largest to smallest singular values of the matrix.) Therefore, we have $$\kappa(C)=\max\left(\sqrt{\frac{2(g^2+1)}{g^2+2g\cos(\omega\tau_c)+1}-1},\ \sqrt{\frac{2(g^2+1)}{g^2-2g\cos(\omega\tau_c)+1}-1}\right).$$

Using the first and second derivatives of this function, as was done for the previous spectra, the following are the maxima and minima:

$$\kappa^{\uparrow}(C)=\frac{1+g}{1-g}\ \text{at}\ \omega\tau_c=n\pi,\ \text{with}\ n=0.1,2,3,4,\ldots \tag{20}$$

$$\kappa^{\downarrow}(C)=1\ \text{at}\ \omega\tau_c=n\frac{\pi}{2},\ \text{with}\ n=1,3,5,7,\ldots \tag{21}$$

First, it is noted that the peaks and minima in the condition number occur at the same frequencies as those of the amplitude envelope spectrum at the loudspeakers, $\hat{S}^{[P]}$. Second, it is noted that the minima have a condition number of unity (the lowest possible value), which implies that the XTC filter resulting from the inversion of C is most robust (i.e., least sensitive to errors in the transfer matrix) at the non-dimensional frequencies $$\omega\tau_c=\frac{\pi}{2},\frac{3\pi}{2},\frac{5\pi}{2},\ldots.$$

Conversely, the condition number can reach very high values (e.g., $\kappa^T(C)=132.3$ for typical case of $g=0.985$) at the non-dimensional frequencies $\omega\tau_c=0,\pi,2\pi,3\pi\ldots$. As $g\rightarrow 1$ the matrix inversion resulting in the P-XTC filter becomes ill-conditioned, or in other words, infinitely sensitive to errors. The slightest misalignment, for instance, of the listener's head, would thus result in a severe loss in XTC control at the ears (at and near these frequencies) which, in turn, causes the severe spectral coloration in $\hat{S}^{[P]}(\omega)$ to be transmitted to the ears.

Deficiencies of Constant-Parameter Regularization

Regularization methods allow controlling the norm of the approximate solution of an ill-conditioned linear system at the price of some loss in the accuracy of the solution. The control of the norm through regularization can be done subject to an optimization prescription, such as the minimization of a cost function. Regularization may be discussed analytically in the context of XTC filter optimization, which may be defined as the maximization of XTC performance for a desired tolerable level of spectral coloration or, equivalently, the minimization of spectral coloration for a desired minimum XTC performance.

A pseudoinverse representing a nearby solution to the matrix inversion problem is sought:

$$H^{[\beta]}=fC^HC+\beta I)^{-1}C^H \tag{22}$$

where the superscript H denotes the Hermitian operator, and $\beta$ is the regularization parameter which essentially causes a departure from $H^{[P]}$, the exact inverse of C. $\beta$ is taken to be a constant, $0<\beta<<1$. The pseudoinverse matrix, $H^{[\beta]}$, is the regularized filter, and the superscript $[\beta]$ is used to denote constant-parameter regularization. The regularization stated in Eq. (22) corresponds to a minimization of a cost function, $J(i\omega)$, $$J(i\omega)=e^H(i\omega)e(i\omega)+\beta v^H(i\omega)v(i\omega) \tag{23}$$

where the vector e represents a performance metric that is a measure of the departure from the signal reproduced by the perfect filter. Physically, then, the first term in the sum constituting the cost function represents a measure of the performance error, and the second term represents an "effort penalty," which is a measure of the power exerted by the loudspeakers. For $\beta>0$, Eq. (22) leads to an optimum, which corresponds to the least-square minimization of the cost function $J(i\omega)$.

Therefore, an increase of the regularization parameter $\beta$ leads to a minimization of the effort penalty at the expense of a larger performance error and thus to an abatement of the peaks in the norm of H, i.e., the coloration peaks in the $S(\omega)$ spectra, at the price of a decrease in XTC performance at and near the frequencies where the system is ill-conditioned.

Using the explicit form for C given by Eq. (12), the frequency response of the constant parameter regularization XTC filter becomes:

$$H^{[\beta]}=\begin{bmatrix} H_{LL}^{[\beta]}(i\omega) & H_{LR}^{[\beta]}(i\omega) \\ H_{RL}^{[\beta]}(i\omega) & H_{RR}^{[\beta]}(i\omega)\end{bmatrix}. \tag{24}$$

where $$\begin{aligned} H_{LL}^{[\beta]}(i\omega)&=H_{RR}^{[\beta]}(i\omega) \\ &=\frac{g^2e^{i4\omega\tau_c}-(\beta+1)e^{i2\omega\tau_c}}{g^2e^{i4\omega\tau_c}+g^2-[(g^2+\beta)^2+2\beta+1]}, \end{aligned} \tag{25}$$

$$\begin{aligned} H_{LR}^{[\beta]}(i\omega)&=H_{RL}^{[\beta]}(i\omega) \\ &=\frac{ge^{i\omega\tau_c}-g(g^2+\beta)e^{i3\omega\tau_c}}{g^2e^{i4\omega\tau_c}+g^2-[(g^2+\beta)^2+2\beta+1]}. \end{aligned} \tag{26}$$

The eight metric spectra we defined herein become:

$$\begin{aligned} E_{si_{\|}}^{[\beta]}(\omega)&=\frac{g^4+\beta g^2-2g^2\cos(2\omega\tau_c)+\beta+1}{-2g^2\cos(2\omega\tau_c)+(g^2+\beta)^2+2\beta+1}; \\ E_{si_x}^{[\beta]}(\omega)&=\frac{2g\beta|\cos(\omega\tau_c)|}{-2g^2\cos(2\omega\tau_c)+(g^2+\beta)^2+2\beta+1}; \\ E_{ci}^{[\beta]}(\omega)&=\frac{1}{2}-\frac{\beta}{2[g^2+2\cos(\omega\tau_c)+\beta+1]}; \\ S_{si_{\|}}^{[\beta]}(\omega)&=\frac{\sqrt{g^4-2(\beta+1)g^2\cos(2\omega\tau_c)+(\beta+1)^2}}{-2g^2\cos(2\omega\tau_c)+(g^2+\beta)^2+2\beta+1}; \\ S_{si_x}^{[\beta]}(\omega)&=\frac{g\sqrt{(g^2+\beta)^2-2(g^2+\beta)\cos(2\omega\tau_c)+1}}{-2g^2\cos(2\omega\tau_c)+(g^2+\beta)^2+2\beta+1}; \\ S_{ci}^{[\beta]}(\omega)&=\frac{\sqrt{g^2+2g\cos(\omega\tau_c)+1}}{2[g^2+2g\cos(\omega\tau_c)+\beta+1]}; \\ \hat{S}^{[\beta]}(\omega)&=\max\left(\frac{\sqrt{g^2+2g\cos(\omega\tau_c)+1}}{g^2+2g\cos(\omega\tau_c)+\beta+1},\ \frac{\sqrt{g^2-2g\cos(\omega\tau_c)+1}}{g^2-2g\cos(\omega\tau_c)+\beta+1}\right); \end{aligned} \tag{27}$$

-continued $$\chi^{[\beta]}(\omega) = \frac{g^4 + \beta g^2 - 2g^2\cos(2\omega\tau_c) + \beta + 1}{2g\beta|\cos(\omega\tau_c)|}. \quad (28)$$

It is worth noting that as $\beta \to 0$, $H^{[\beta]} \to H^{[P]}$ and the spectra of the perfect XTC filter are recovered from the expressions above as expected.

Figure 3:
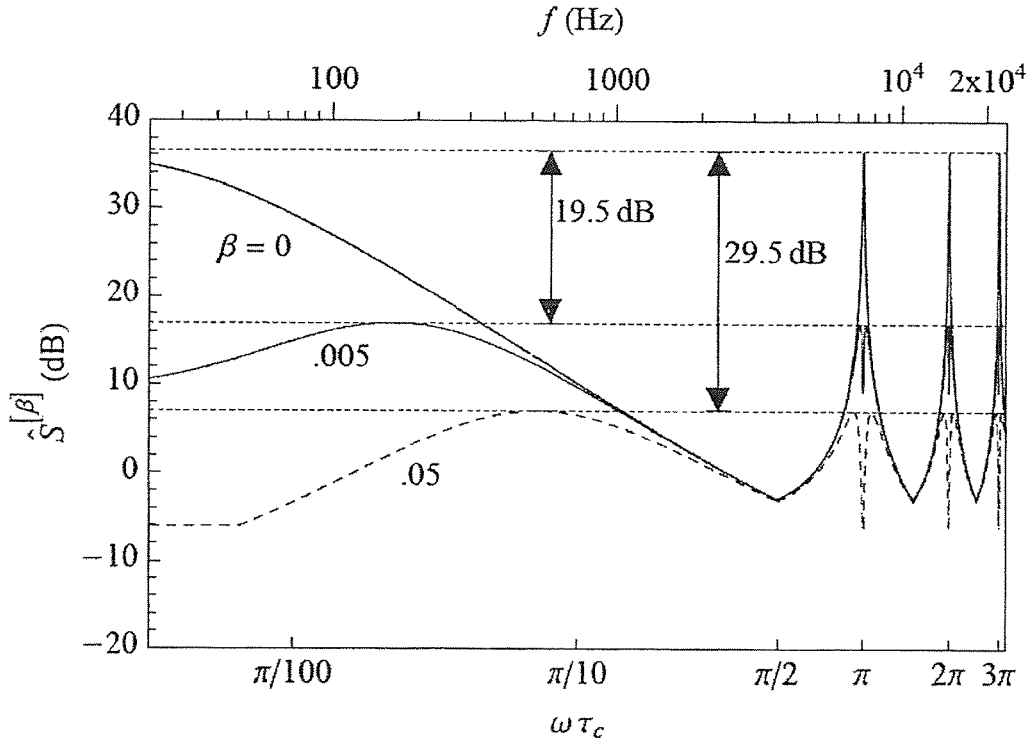
FIG. 3 is a plot showing the effects of regularization on the envelope spectrum at the loudspeakers.

The envelope spectrum, $\hat{S}^{[\beta]}(\omega)$, is plotted in FIG. 3 for three values of β. Two features can be noted in that plot: 1) increasing the regularization parameter attenuates the peaks in the spectrum without affecting the minima, and 2) with increasing β the spectral maxima split into doublet peaks (two closely-spaced peaks).

To get a measure of peak attenuation and the conditions for the formation of doublet peaks, the first and second derivatives of $\hat{S}^{[\beta]}(\omega)$ with respect to $\omega\tau_c$ are used to find the conditions for which the first derivative is nil and the second is negative. These conditions are summarized as follows: If β is below a threshold β* defined as $$\beta < \beta^* \equiv (g-1)^2. \quad (29)$$

the peaks are singlets and occur at the same non-dimensional frequencies as for the envelope spectrum peaks of the P-XTC filter ($\hat{S}^{[P]\uparrow}$), and have the following amplitude:

$$\hat{S}^{[\beta]\uparrow} = \frac{1-g}{(g-1)^2 + \beta}$$

at $\omega\tau_c = n\pi$, with n=0, 1, 2, 3, 4, . . .

If the condition $$\beta^* \leq \beta = 1 \quad (30)$$

is satisfied, the maxima are doublet peaks located at the following non-dimensional frequencies:

$$\omega\tau_c = n\pi \pm \cos^{-1}\left(\frac{g^2 - \beta + 1}{2g}\right) \text{ with } n = 0, 1, 2, 3, 4, \ldots \quad (31)$$

and have an amplitude $$\hat{S}^{[\beta]\uparrow\uparrow} = \frac{1}{2\sqrt{\beta}}, \quad (32)$$

which does not depend on g. (The superscripts ↑ and ↑↑ denote singlet and doublet peaks, respectively.) The attenuation of peaks in the $\hat{S}^{[\beta]}$ spectrum due to regularization can be obtained by dividing the amplitude of the peaks in the P-XTC (i.e., β=0) spectrum by that of peaks in the regularized spectrum. For the case of singlet peaks, the attenuation is $$20\log_{10}\left(\frac{\hat{S}^{[P]\uparrow}}{\hat{S}^{[\beta]\uparrow}}\right) = 20\log_{10}\left[\frac{\beta}{(g-1)^2 + 1}\right] \text{ dB}.$$

and for doublet peaks, it is given by $$20\log_{10}\left(\frac{\hat{S}^{[P]\uparrow}}{\hat{S}^{[\beta]\uparrow\uparrow}}\right) = 20\log_{10}\left[\frac{2\sqrt{\beta}}{1-g}\right] \text{ dB}.$$

For the typical case of g=0.985 illustrated in FIG. 2, we have $\beta^* = 2.225\times10^{-4}$, and for β=0.005 and 0.05 we get doublet peaks that are attenuated (with respect to the peaks in the P-XTC spectrum) by 19.5 and 29.5 dB, respectively, as marked on that plot. Therefore, increasing the regularization parameter above this (typically low) threshold causes the maxima in the envelope spectrum to split into doublet peaks shifted by a frequency $$\Delta(\omega\tau_c) = \cos^{-1}\left[\frac{g^2 - \beta + 1}{2g}\right]$$

to either side of the peaks in the response of the perfect XTC filter. (For an illustrative case of g=0.935, it is found that $\beta^* = 2.225\times10^{-4}$ and $\Delta(\omega\tau_o)$; 0.225 for β=0.05). Due to the logarithmic nature of frequency perception for humans, these doublet peaks are perceived as narrow-band artifacts at high frequencies (i.e., for n=1, 2, 3, . . . ), but the first doublet peak centered at n=0 is perceived as a wide-band low-frequency rolloff of typically many dB, as can be clearly seen in FIG. 3. Therefore, constant-β regularization transforms the bass boost of the perfect XTC filter into a bass roll-off.

Figure 4:
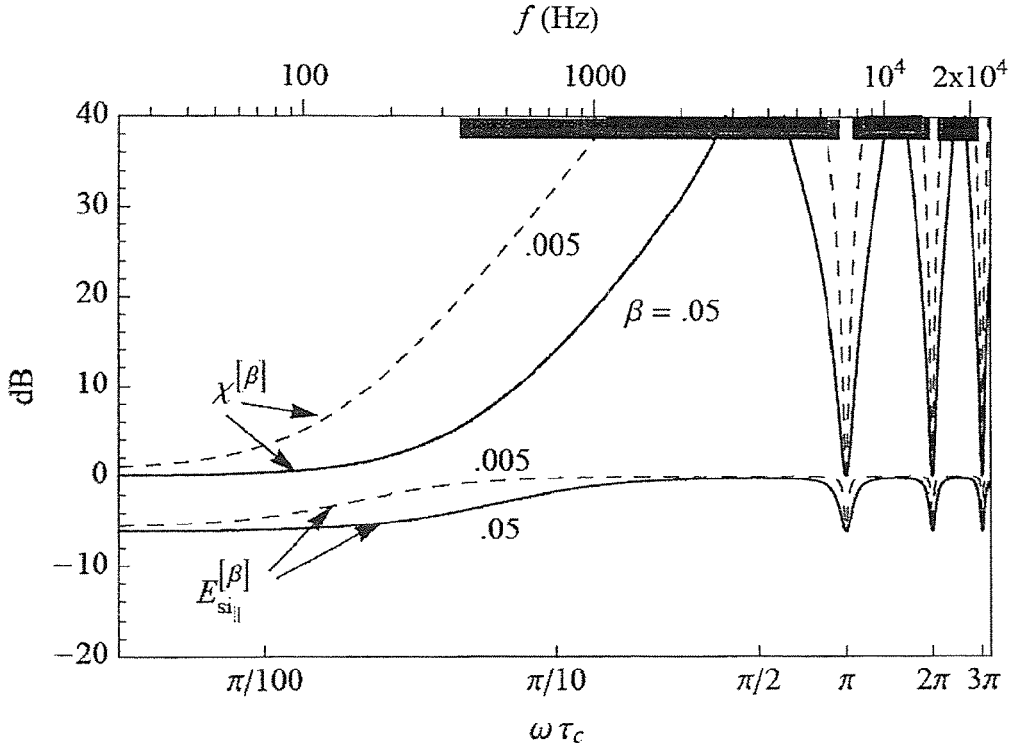
FIG. 4 shows the effects of regularization on the crosstalk cancellation spectrum.

Since regularization is essentially a deliberate introduction of error into system inversion, it is expected that both the XTC spectrum and the frequency responses at the ears will suffer (i.e., depart from their ideal P-XTC filter levels of ∞ and 0 dB, respectively) with increasing β. The effects of constant-parameter regularization on responses at the ears are illustrated in FIG. 4 which shows the effects of regularization on the crosstalk cancellation spectrum, $\chi^{[\beta]}(\omega)$ (top two curves), and the ipsilateral frequency response at the ear for a side image, $$E_{si_{\parallel}}(\omega).$$

The black horizontal bars on the top axis mark the frequency ranges for which an XTC level of 20~dB or higher is reached with β=0.05, and the grey bars represent the same for the case of β=0.005. (Other parameters are the same as for FIG. 2).

The black curves in that plot represent the crosstalk cancellation spectra and show that XTC control is lost within frequency bands centered around the frequencies where the system is ill-conditioned ($\omega\tau_c = n\pi$ with n=0, 1, 2, 3, 4, . . . ) and whose frequency extent widens with increasing regularization. For example, increasing β to 0.05 limits XTC of 20 dB or higher to the frequency ranges marked by black horizontal bars on the top axis of that figure, with the first range extending only from 1.1 to 6.3 kHz and the second and third ranges located above 8.4 kHz. In many practical applications, such high (20 dB) XTC levels may not be needed or achievable (e.g., because of room reflections and/or mismatch between the HRTF of the listener and that used (e.g. dummy head) to design the filter, and the higher values of β needed to tame the spectral coloration peaks below a required level at the loudspeakers may be tolerated.

The $$E_{si_{ll}}^{[\beta]}(\omega)$$

responses at the ears, shown as the bottom curves in FIG. 4, depart only by a few dB from the corresponding P-XTC (i.e., β=0) filter response (which is a flat curve at 0 dB). More precisely and generally, the maxima and minima of the $$E_{si_{ll}}^{[\beta]}(\omega)$$

spectrum are given by:

$$E_{si_{ll}}^{[\beta]\uparrow} = \frac{g^2+1}{g^2+\beta+1} \text{ at } \omega\tau_c = n\frac{\pi}{2}, \text{ with } n = 1, 3, 5, \ldots$$

$$E_{si_{ll}}^{[\beta]\downarrow} = \frac{g^4+(\beta-2)g^2+\beta+1}{g^4+2(\beta-1)g^2+(\beta+1)^2} \text{ at } \omega\tau_c = n\pi,$$

$$\text{with } n = 0, 1, 2, 3, 4, \ldots$$

For the typical (g=0.985) example shown in the figure, for $$\beta = .05.\ E_{si_{ll}}^{[\beta]\uparrow} = -.2 \text{ dB and } E_{si_{ll}}^{[\beta]\downarrow} = -6.1 \text{ dB},$$

showing that even relatively aggressive regularization results in a spectral coloration at the ears that is quite modest compared to the spectral coloration the perfect XTC filter imposes at the loudspeakers.

In sum, while constant-parameter regularization, a commonly used technique in the design of XTC filters, is effective at reducing the amplitude of peaks (including the "low-frequency boost") in the envelope spectrum at the loudspeakers, it typically results in undesirable narrow-band artifacts at higher frequencies and a rolloff of the lower frequencies at the loudspeakers. This non-optimal behavior can be avoided if the regularization parameter is allowed to be a function of the frequency, as described herein.

Spectral Flattening through Frequency-Dependent Regularization

The method and system of the present invention rely on the use of a specific scheme for calculating the frequency-dependent regularization parameter (FDRP) that would result in the flattening of the amplitude vs frequency spectrum measured at the loudspeakers and not at the ears of the listeners as is implicit in previous XTC filter designs that are based on the inversion of the system transfer matrix.

Flattening of the amplitude vs frequency spectrum measured at the loudspeakers, as opposed to at the ear of the listener, forces XTC to result from phase effects only, and not from amplitude effects, since the amplitude is flat with frequency at the loudspeakers. This means that any inherent spectral (i.e. amplitude vs frequency) coloration in the loudspeaker and/or playback hardware will not be corrected for (as is inherently done in previous inversion-based XTC filter design methods where the XTC filter aims to reproduce at the ears the same amplitude vs frequency response of the recorded the signal).

Flattening of the amplitude vs frequency spectrum measured at the loudspeakers, results in the listener hearing the same amplitude vs frequency response that would be heard without processing the sound through the XTC filter. This implies that the listener would not hear any spectral coloration beyond that due to the playback hardware and loudspeakers without the filter. Equally important is the fact that such a flat filter response at the loudspeakers also means no dynamic range loss in the processed audio.

In order to explain method and system of the present invention, an idealized analytical description of how to calculate a frequency-dependent regularization parameter will be described that results in the specific goal of flattening the XTC filter response at the loudspeakers.

Description of the Method of the Present Invention in the Context of the Idealized Model For the sake of clarity, the same optimization scheme described with respect to the minimization of the cost function expressed in Eq. (23)) will be used, keeping in mind that the method and system of the present invention are completely independent of the adopted optimization scheme In order to avoid the frequency-domain artifacts discussed above and illustrated in FIG. 3, a frequency-dependent regularization parameter is calculated that would cause the envelope spectrum $\hat{S}(\omega)$ to be flat at a desired level Γ (in dB) over the frequency bands where the perfect filter's envelope spectrum exceeds Γ. Outside these bands (i.e., where the $\hat{S}^{[P]}(\omega)$ is below Γ), we apply no regularization. This can be stated symbolically as:

$$\hat{S}(\omega)=\gamma \text{ if } \hat{S}^{[P]}(\omega)\geq\gamma \tag{33}$$

$$\hat{S}(\omega) = \hat{S}^{[P]}(\omega) \text{ if } \boxed{\hat{S}^{[P]}(\omega) < \gamma} \tag{34}$$

where the P-XTC envelope spectrum, $\hat{S}^{[P]}(\omega)$, is given by Eq. (16), and $$\gamma=10^{\Gamma/20} \tag{35}$$

with Γ given in dB. Γ cannot exceed the magnitude of the peaks in the $\hat{S}^{[P]}(\omega)$ spectrum, γ is bounded by:

$$\gamma \leq \frac{1}{1-g} \tag{36}$$

where the bound is the maxima of the $\hat{S}^{[P]}$ spectra, $\hat{S}^{[P]\uparrow}$, given by Eq. (18).

The frequency-dependent regularization parameter needed to effect the spectral flattening required by Eq. (33) is obtained by setting $\hat{S}^{[\beta]}(\omega)$, given by Eq. (27), equal to γ and solving for β(ω), which is now a function of frequency. Since the regularized spectral envelope, $\hat{S}^{[\beta]}(\omega)$, (which is also $\|H^{[\beta]}\|$, the 2-norm of the regularized XTC filter) is the maximum of two functions, two solutions for β(ω) are obtained:

$$\beta_I(\omega) = -g^2 + 2g\cos(\omega\tau_c) + \frac{\sqrt{g^2 - 2g\cos(\omega\tau_c) + 1}}{\gamma} - 1, \tag{37}$$

$$\beta_{II}(\omega) = -g^2 - 2g\cos(\omega\tau_c) + \frac{\sqrt{g^2 + 2g\cos(\omega\tau_c) + 1}}{\gamma} - 1. \tag{38}$$

The first solution, $\beta_E(\omega)$, applies for frequency bands where the out-of-phase response of the perfect filter (i.e., the second singular value, which is the second argument of the max□ function in Eq. (16)) dominates over the in-phase response (i.e., the first argument of that function):

$$S_o^{[P]} = \frac{1}{\sqrt{g^2 - 2g\cos(\omega\tau_c) + 1}}$$

$$\geq S_i^{[P]} = \frac{1}{\sqrt{g^2 + 2g\cos(\omega\tau_c) + 1}}. \quad (39)$$

Similarly, regularization with $\beta_H(\omega)$ applies for frequency bands where $S_i^{[P]} \geq S_o^{[P]}$. Therefore, we must distinguish between three branches of the optimized solution: two regularized branches corresponding to $\beta=\beta_1(\omega)$ and $\beta=\beta_H(\omega)$, and one non-regularized (perfect-filter) branch corresponding to $\beta=0$. We call these Branch I, II and P, respectively, and sum up the conditions associated with each as follows:

Branch I; applies where $\hat{S}^{[P]}(\omega) \geq \gamma$ and $S_o^{[P]} \geq S_i^{[P]}$, and requires setting $\hat{S}(\omega)=\gamma$, $\beta=\beta_I(\omega)$;

Branch II: applies where $\hat{S}^{[P]}(\omega \geq \gamma$ and $S_i^{[P]} \geq S_o^{[P]}$, and requires setting $\hat{S}(\omega)=\gamma$, $\beta=\beta_H(\omega)$;

Branch P: applies where $\hat{S}^{[P]}(\omega) < \gamma$, and requires setting $\hat{S}(\omega)=\hat{S}^{[P]}(\omega)$, $\beta=0$.

Figure 5:
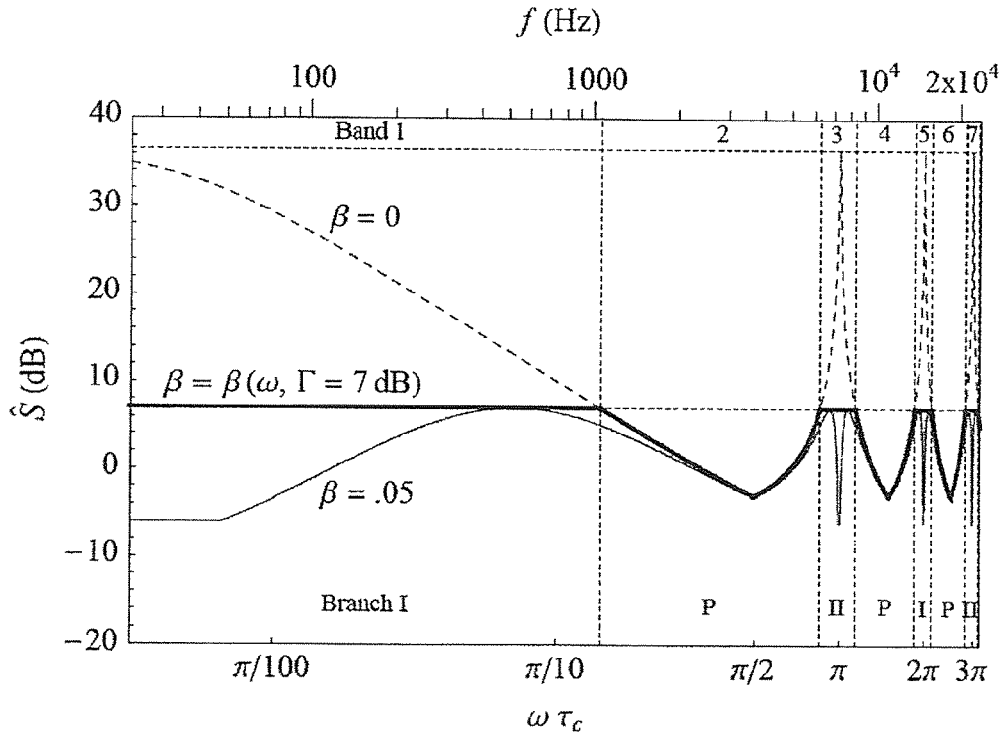
FIG. 5 is a plot showing the envelope spectrum at the loudspeakers.

Following this three-branch division, the envelope spectrum at the loudspeakers, $\hat{S}(\omega)$, for the case of frequency-dependent regularization is plotted as the thick black curve in FIG. 5 for $\Gamma=7$ dB. This value was chosen because it corresponds to the magnitude of the (doublet) peaks in the $\beta=0.05$ spectrum (i.e., $$\Gamma = 20\log_{10}\left(\frac{1}{2\sqrt{\beta}}\right)),$$

which is also plotted (light solid curve) as a reference for the corresponding case of constant-parameter regularization. (We call a spectrum obtained with frequency-dependent regularization and one obtained with constant-$\beta$ regularization "corresponding spectra," if the peaks in $\hat{S}^{[\beta]}(\omega)$, whether singlets or doublets, are equal to $\gamma$.)

It is seen from that figure that the low-frequency boost and the high-frequency peaks of the perfect XTC spectrum, which would be transformed into a low-frequency roll-off and narrow-band artifacts, respectively, by constant-$\beta$ regularization, are now flat at the desired maximum coloration level, $\Gamma$. The rest of the spectrum, i.e., the frequency bands with amplitude below $\Gamma$, is allowed to benefit from the infinite XTC level of the perfect XTC filter and the robustness associated with relatively low condition numbers.

In the method of the present invention $\gamma$ is specifically chosen to be at or below the value equal to the lowest value of the $\hat{S}^{[\beta]}(\omega)$ spectrum, i.e.

$$\hat{S}^{[P]\downarrow} \geq \gamma \quad (40)$$

as this would insure that the entire spectrum $\hat{S}^{[\beta]}(\omega)$ is flat (i.e. the inequality in (34) does not hold and Branch P disappears) and XTC would be forced to be effected through phase effects only, resulting in no amplitude coloration due to XTC filtering and no dynamic range loss, all while insuring the minimization of whatever cost function is prescribed by the adopted optimization scheme (in this particular example, Eq. (23)).

Generalized Method

Figure 6:
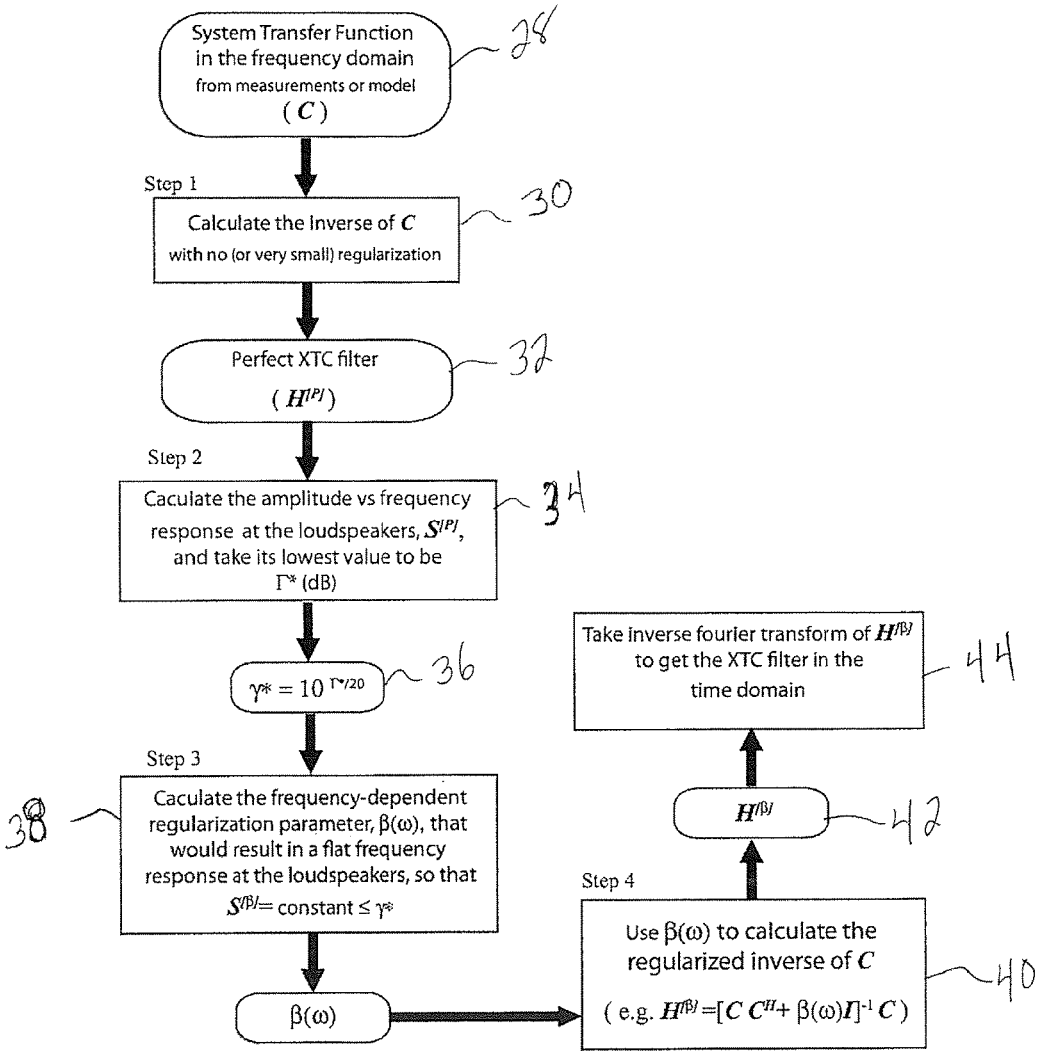
FIG. 6 is a flow chart of the method of the present invention.

The above leads us to a general description of the method of the present invention in terms of specific steps that are taken in the XTC filter design procedure (the steps are also shown schematically in FIG. 6 along with the associated input and output for each step):

In step 30, the system's transfer matrix in the frequency domain (i.e. matrix C as in Eq. (12) and the input 28) is inverted, either analytically (if it results from a tractable idealized model) or numerically (if it results from experimental measurements), using zero or a very small constant regularization parameter (large enough to avoid machine inversion problems) to obtain the corresponding perfect XTC filter, $H^{[P]}$.

In step 34 $\Gamma$ is set equal to $\Gamma^*$,be the lowest value (in dB) reached by the amplitude vs frequency response at the loudspeakers, $\hat{S}^{[P]\downarrow}$ in Step 34. This is found from either Eq. (19) (or a similar equation resulting from another tractable analytical model) or from plotting the $H^{[P]}$ spectra (if the inversion was done numerically using actual measurements as in the example given further below) then calculate $\gamma$ from $\gamma^*=10^{\Gamma^*/20}$ (36).

In Step 38, the frequency-dependent regularization parameter (FDRP) $\beta(\omega)$ that would result in a flat frequency response at the loudspeakers is calculated, so that $\hat{S}^{[\beta]}(\omega)=$ constant $\leq\gamma^*$ (as, for instance, is done by using Equations (37) and (38)) thus forcing XTC to be caused by phase effects only.

In Step 40, the FDRP thus obtained, $\beta(\omega)$, is used to calculate the pseudo-inverse of the system's transfer matrix (e.g. according to Eqn. (22)), which yields the sought regularized optimal XTC filter $H^{[\beta]}$ that has a flat frequency response at the loudspeakers. (Finally, if needed for applying the resulting filter through a time-base convolution, as is often done in practical XTC implementation), a time domain version (impulse response) of the filter is obtained in step 44 by simply taking the inverse Fourier transform of $H^{[\beta]}$ (output 42).)

It should be noted that in Step 38, if the FDRP is calculated so that $\hat{S}^{[\beta]}(\omega)$=constant $\leq\gamma^*$, the spectral flattening occurs for a side image (i.e. a sound panned to either the left or right channel and thus would be perceived by a listener to be located at or near his or left or right ear when the XTC level is sufficiently high). However, the same method can be used to flatten the response at the loudspeakers for an image that is not a pure side image by simply requiring that $S^{[\beta]}(\omega)$=constant $\leq\gamma^*$, where $S^{[\beta]}(\omega)$ is the XTC filter's frequency response for an image of source panned anywhere between the left and right channels. For instance, to flatten for a central image, we set $S^{[\beta]}_{ci}(\omega)$, (given, for instance, by the equation preceding Eqn. 27) to a constant $\leq\gamma^*$, and proceed with the steps of the method as outlined above. In this context it is relevant to mention that for some applications, for instance pop music recording where the lead vocal audio is panned dead center, it might be desirable to flatten the response for a center image, i.e. $S_{ci}(\omega)$, (or an image of any other desired panning) in order to avoid coloration of that image. It should also be noted in that context that since $\hat{S}^{[\beta]}(\omega) \geq S^{[\beta]}(\omega)$ only flattening the side image (i.e. setting $\hat{S}^{[\beta]}(\omega)$=constant $\leq\gamma^*$) would result in no dynamic range loss due to the XTC filter. In other words, flattening for anything but the side image would incur a dynamic range loss that must be balanced by the benefit of a reduced spectral coloration for the desired panned image. For instance, for binaural recordings of real acoustic soundfields, which typically contain no dead-center panned images, flattening of the side image is advisable as this leads to no dynamic range loss.

Example Using a Measured Transfer Function.

An example based on the transfer function of two loudspeakers in a room measured by microphones placed at the ear canal entrances of a dummy head (Neumann KU-100) will now be described. The loudspeakers had a span of 60 degrees at the listening position, which was about 2.5 meters from each loudspeaker.

Figure 7:
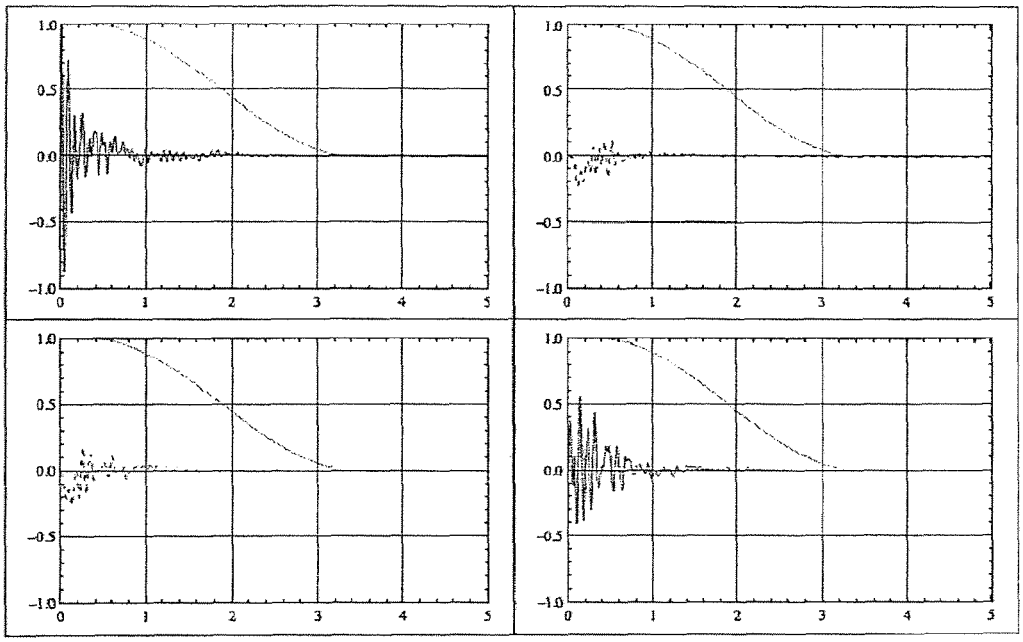
FIG. 7 shows four (windowed) measured impulse responses (IR) representing the transfer function in the time domain.

FIG. 7 shows the four (windowed) measured impulse responses (IR) representing the transfer function in the time domain. The x-axis of each plot in FIG. 7 is time in ms, and the γ-axis is the normalized amplitude of the measured signal. The top left plot shows the II of the left loudspeaker measured at the left ear of the dummy head, and the bottom left plot shows the IR of the left loudspeaker measured at the right ear of the dummy head. The top right plot is the IR of the right speaker—left ear transfer function and the bottom plot is the IR of the right speaker—right ear transfer function.

Figure 8:
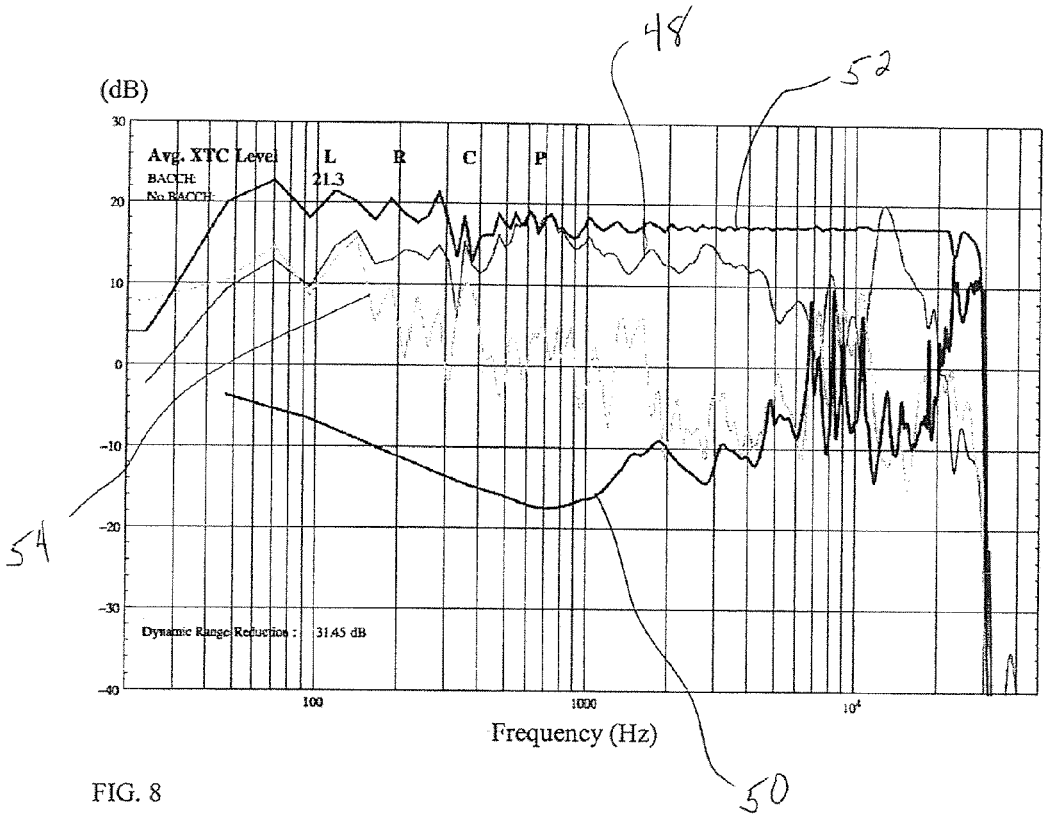
FIG. 8 is a graph showing measured spectra associated with a perfect XTC filter

FIG. 8, shows relevant spectra where the x-axis is frequency in Hz and they-axis is amplitude in dB. The curve 48 in that plot is the frequency response $C_{LL}$ that corresponds to the left speaker-left ear transfer function in the frequency domain obtained by panning the test sound completely to the left channel. The ripples in curve 48 above 5 kHz are due to the HRTF of the head and the left ear pinna. The other curves 50, 52 54 in that plot are the measured frequency responses associated with the perfect XTC filter, that is an XTC filter obtained by inverting the transfer function with essentially no regularization ($\beta=10^{-5}$). In particular, Curve 50 is the response at the left loudspeaker $\hat{S}^{[P]}(\omega)$ and shows a dynamic range loss of 31.45 dB (difference between the maximum and minimum in that curve). Curve 52 is the frequency response at the left (ipsilateral) ear, $E_{si_u}$, which, as expected from a perfect XTC filter, is essentially flat over the entire audio band. The curve 54 is the corresponding frequency response measured at the right (contralateral) ear, $E_{si_x}$, and shows significant attenuation with respect to curve 52 due to XTC. The difference in amplitude between the curves 52 and 54 linearly averaged over frequencies is the average XTC level, which for this case is 21.3 dB.

Figure 9:
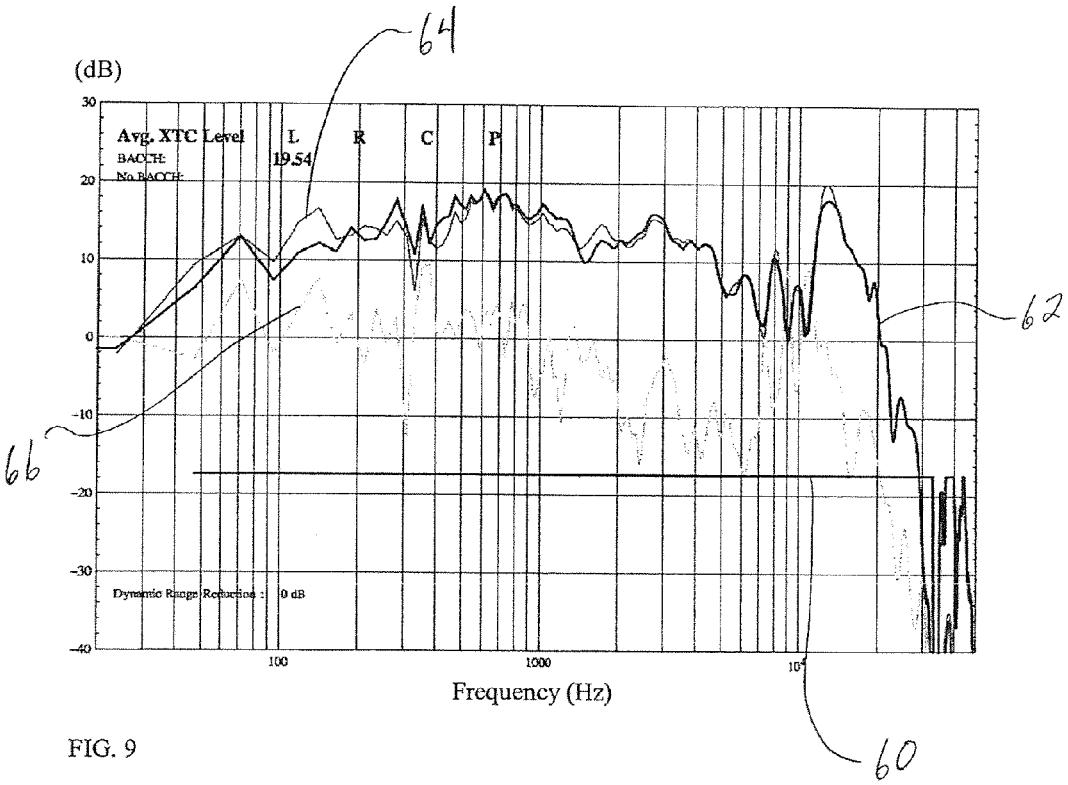
FIG. 9 is a graph showing measured spectra for an XTC filter of the present invention.

We contrast these curves with those curves in FIG. 9 which shows the responses due to a filter designed in accordance with the present invention. By design, curve 60, representing, $\hat{S}^{[\beta]}(\omega)$, the response at the left loudspeaker, is completely flat over the entire audio spectrum. Consequently, the frequency response at the left ear, curve 62, matches very well the corresponding measured system transfer function, $C_{LL}$, shown in curve 64. Since $\hat{S}^{[\beta]}(\omega)$ is flat, there is no dynamic range loss associated with this filter. The average XTC level for this filter (obtained by taking the linear average of the difference between curve 62 and 66) is 19.54 dB, which is only 1.76 dB lower than the XTC level obtained with the perfect filter, testifying to the optimal nature of the regularized filter. [In sum, the filter designed with the method of the present invention, imposes no audible coloration to the sound of the playback system, has no dynamic range loss, and yields an XTC level that is essentially the same as that of a perfect XTC filter.

The method described herein may be implemented in software, or firmware incorporated in a computer-readable storage medium for execution by a general purpose computer or a processor, such as a DSP chipset. Examples of suitable computer-readable storage mediums include a read only memory (ROM), a random access memory (RAM), a register, cache memory, semiconductor memory devices, magnetic media such as internal hard disks and removable disks, magneto-optical media, and optical media such as CD-ROM disks, and digital versatile disks (DVDs).

Embodiments of the present invention may be represented as instructions and data stored in a computer-readable storage medium. For example, aspects of the present invention may be implemented using Verilog, which is a hardware description language (HDL). When processed, Verilog data instructions may generate other intermediary data, (e.g., netlists, GDS data, or the like), that may be used to perform a manufacturing process implemented in a semiconductor fabrication facility. The manufacturing process may be adapted to manufacture semiconductor devices (e.g., processors) that embody various aspects of the present invention.

Suitable processors include, by way of example, a general purpose processor, a special purpose processor, a conventional processor, a digital signal processor (DSP), a plurality of microprocessors, a graphics processing unit (GPU), a DSP core, a controller, a microcontroller, application specific integrated circuits (ASICs), field programmable gate arrays (FPGAs), any other type of integrated circuit (IC), and/or a state machine, or combinations thereof.

While the foregoing invention has been described with reference to its preferred embodiments, various alterations and modifications will occur to those skilled in the art. All such alterations and modifications are intended to fall within the scope of the appended claims.

The invention claimed is:

1. A method for filtering audio signals to cancel loudspeaker crosstalk in an audio system including loudspeakers, said method comprising the steps of inverting a transfer matrix or function of the audio system;

using information from the inverted transfer matrix or function to calculate a frequency-dependent regularization parameter that is used to calculate a regularized inverse of the transfer matrix or function to obtain crosstalk cancellation filters that have a flat frequency response at an input of any of the loudspeakers of the audio system over an audio band or a portion thereof; and applying said crosstalk cancellation filters to audio signals at the input of one or more of the loudspeakers.

2. The method for filtering audio signals to cancel loudspeaker crosstalk of claim 1 wherein said crosstalk cancellation filters effect cancellation only through phase effects over said audio band or portion thereof.

3. The method for filtering audio signals to cancel loudspeaker crosstalk of claim 1, wherein said crosstalk cancellation filters have a flat frequency response at an input of one or more of the loudspeakers for a desired image panned anywhere between left and right channels.

4. The method for filtering audio signals to cancel loudspeaker crosstalk of claim 1 wherein said audio system uses binaural audio signals for input.

5. The method for filtering audio signals to cancel loudspeaker crosstalk of claim 1 wherein said audio system is a stereo audio system.

6. The method of filtering audio signals to cancel crosstalk of claim 1 wherein the step of inverting the transfer matrix or function of the audio system comprises of calculating the inverse of the transfer matrix or functions over an entire audio spectrum without dividing the audio spectrum into bands.

7. A method for designing crosstalk cancellation filters for i audio applications comprising the steps of inverting a transfer matrix or function of an audio system including loudspeakers; and using information from the inverted transfer matrix or function to calculate a frequency-dependent regularization parameter that is used to calculate a regularized inverse of said transfer matrix or function to obtain crosstalk cancellation filters that have a flat frequency response at the input of any of the loudspeakers of the audio system over an audio band or a portion thereof.

8. The method for designing crosstalk cancellation filters for cancelling crosstalk in loudspeakers of audio applications of claim 7 wherein said crosstalk cancellation filters effect crosstalk cancellation only through phase effects over said audio band or portion thereof.

9. The method for designing crosstalk cancellation filters for cancelling crosstalk in loudspeakers of audio applications of claim 7, wherein said crosstalk cancellation filters have a flat frequency response at one of the loudspeakers for a desired image panned anywhere between left and right channels.

10. The method for designing crosstalk cancellation filters for cancelling crosstalk in loudspeakers of claim 7 wherein said audio system uses binaural audio signals for input.

11. The method for designing crosstalk cancellation filters for cancelling cross talk in loudspeakers of claim 7 wherein said audio system is a stereo audio system.

12. A system for filtering audio signals to cancel crosstalk in an audio system including loudspeakers comprising:

an audio input stage;

a processor for inverting a transfer matrix or function of the audio system calculating a frequency-dependent regularization parameter that is used to calculate a regularized inverse of said transfer matrix or function to obtain crosstalk cancellation filters that have a flat frequency response at an input of any of the loudspeakers of the audio system over an audio band or a portion thereof;

calculating the pseudo inverse of said transfer matrix using said calculated frequency-dependent regularization parameter; and applying said crosstalk cancellation filters to audio signals at the input of one or more of the loudspeakers.

13. The system for filtering audio signals to cancel loudspeaker crosstalk in an audio system of claim 12 wherein said crosstalk cancellation is effected by said processor only through phase effects over said audio band or portion thereof.

14. The system for filtering audio signals to cancel loudspeaker crosstalk in an audio system of claim 12 wherein said processor has the capability of applying said frequency-dependent regularization is used to calculate a regularized inverse of said transfer matrix or function to obtain crosstalk cancellation filters that have a flat frequency response at the input of any of the loudspeakers for a desired image panned anywhere between left and right channels.

15. The system for filtering audio signals to cancel crosstalk in an audio system of claim 12 wherein said processor calculates the inverse of the transfer matrix or functions over an entire audio spectrum without dividing the audio spectrum into bands.

16. A system for producing crosstalk cancellation filters for an audio system including loudspeakers, said system comprising:

an audio input stage;

a processor for inverting a transfer matrix of the audio system;

calculating a frequency-dependent regularization parameter that is used to calculate a regularized inverse of said transfer matrix or function to obtain crosstalk cancellation filters that have a flat frequency response at the input of any of the loud speakers of an audio system over an audio band or a portion thereof.

17. The system for producing crosstalk cancellation filters for audio applications of claim 16 wherein said crosstalk cancellation is effected only through phase effects over said audio band or portion thereof.

18. The system for filtering audio signals to cancel crosstalk in an audio system of claim 16 wherein said crosstalk cancellation filters have a flat frequency response at the input of any of the loudspeakers for a desired image panned anywhere between left and right channels.

* * * * *

UNITED STATES PATENT AND TRADEMARK OFFICE

CERTIFICATE OF CORRECTION

PATENT NO. : 9,167,344 B2
APPLICATION NO. : 13/820230
DATED : October 20, 2015
INVENTOR(S) : Edgar Y. Choueiri It is certified that error appears in the above-identified patent and that said Letters Patent is hereby corrected as shown below:

On the Title Page, under the heading Related U.S. Application Data:

The Provisional application No. "61/379,831" should read -- 61/379,891 --

Signed and Sealed this
Twenty-second Day of March, 2016

Michelle K. Lee

Michelle K. Lee
*Director of the United States Patent and Trademark Office*